US010174580B2

(12) United States Patent
Rowe et al.

(10) Patent No.: US 10,174,580 B2
(45) Date of Patent: Jan. 8, 2019

(54) AUTOMATIC DUMP VALVE AND METHOD OF OPERATING AN INFLATABLE PACKER

(71) Applicant: INFLATABLE PACKERS INTERNATIONAL PTY LTD, Osborne Park, Western Australia (AU)

(72) Inventors: Clement Rowe, Osborne Park (AU); David Knell, Osborne Park (AU)

(73) Assignee: Inflatable Packers International Pty Ltd, Perth (AU)

( * ) Notice: Subject to any disclaimer, the term of this patent is extended or adjusted under 35 U.S.C. 154(b) by 253 days.

(21) Appl. No.: 15/031,556

(22) PCT Filed: Oct. 23, 2014

(86) PCT No.: PCT/AU2014/050303

§ 371 (c)(1),
(2) Date: Apr. 22, 2016

(87) PCT Pub. No.: WO2015/058261

PCT Pub. Date: Apr. 30, 2015

(65) Prior Publication Data

US 2016/0258243 A1 Sep. 8, 2016

(30) Foreign Application Priority Data

Oct. 23, 2013 (AU) ..... 2013904088

(51) Int. Cl.
*E21B 33/127* (2006.01)
*E21B 34/14* (2006.01)
*E21B 34/10* (2006.01)

(52) U.S. Cl.
CPC ..... *E21B 33/127* (2013.01); *E21B 34/10* (2013.01); *E21B 34/14* (2013.01)

(58) Field of Classification Search
CPC ..... E21B 33/127; E21B 34/10; E21B 34/14
See application file for complete search history.

(56) References Cited

U.S. PATENT DOCUMENTS 5,355,959 A 10/1994 Walter et al.
5,605,195 A * 2/1997 Eslinger ..... E21B 33/17 166/187
8,291,984 B2 * 10/2012 Saltel ..... E21B 33/127 166/319

FOREIGN PATENT DOCUMENTS

EP 0214851 A2 3/1987
GB 2472287 A 2/2011

OTHER PUBLICATIONS

International Search Report regarding Application No. PCT/AU2014/050303, dated Feb. 24, 2015.

(Continued)

*Primary Examiner* — David J Bagnell
*Assistant Examiner* — Jonathan Malikasim
(74) *Attorney, Agent, or Firm* — Harness, Dickey & Pierce, P.L.C.

(57) ABSTRACT

A hydraulic dump valve (10) for use with an inflatable packer (38) in a downhole (32) installation. The hydraulic dump valve (10) includes disc springs (102, 118) to adjust the pressure of operation of the valve (10) to allow use of liquid operated packers (38) in boreholes (32) with low static water levels by isolating the hydrostatic pressure in an inflation line (51) from the packers (38) and at the same time provide communication from the inflatable packer (38) to the well annulus (30) to allow downhole deflation of the packer (38).

6 Claims, 4 Drawing Sheets

(56) References Cited

OTHER PUBLICATIONS

Written Opinion regarding Application No. PCT/AU2014/050303, dated Feb. 24, 2015.

* cited by examiner

"Run In"
&
"Dump"

"Inflight"

132
170
162
162
172
168
166
164
174
160

118
118c
118b
118a
102

AUTOMATIC DUMP VALVE AND METHOD OF OPERATING AN INFLATABLE PACKER

CROSS REFERENCE TO RELATED APPLICATIONS

This application is a U.S. National Phase Application under 35 U.S.C. 371 of International Application No. PCT/AU2014/050303, filed Oct. 23, 2014, and published in English as WO 2015/058261 A1 on Apr. 30, 2015. This application is based on and claims priority to Australian Patent Application No. 2013904088, filed Oct. 23, 2013. The entire disclosures of the above applications are incorporated herein by reference.

FIELD OF THE INVENTION

The present invention relates to an automatic dump valve for use in downhole/well applications for managing the running in, inflation and deflation of inflatable packers.

More particularly the automatic dump valve is a hydraulic dump valve that avoids premature inflation of inflatable packers during running in, and permits easy deflation of the inflatable packers once operations are complete.

The hydraulic dump valve of the present invention is for particular use in the field of downhole/well testing and remediation.

The present invention is particularly concerned with operation in situations of low hydrostatic head (so called "dry wells").

The hydraulic dump valve of the present invention can be installed in-line with control rods, or in a control line, or integrated into a setting tool.

TERMINOLOGY

In the fields of well and borehole technology there are a diversity of terminologies used. So as to avoid confusion the following specific terminology is used in the context of the present invention:

- "annular space", in relation to the well bore, is as term used to refer to the annular space between the casing and the open hole;
- "casing" is a term used to refer to any type of pipe casing or the like, used in oil and gas or water well drilling operations. The term "well casing" is often used when referring to casing;
- "deflate" is a term used to refer to deflation of an inflatable bladder of an inflatable packer, and is the opposite of inflation;
- "downhole" is a term used to refer to the a hole drilled in the earth, especially a borehole, and is used to denote any piece of equipment used in the well itself;
- "drill rods" is a term used to refer to long hollow drill rods used in drilling boreholes/wells;
- "drilling fluid" is a term used to refer to any type of slurry or liquid capable of use in drilling a well;
- "dry well" is a term used to refer to a well or bore with low hydrostatic head;
- "hydrostatic head" is a term used to refer to the vertical height of a column of liquid at a given depth (also often referred to as hydrostatic pressure or hydraulic head);
- "inflatable packer" is a term used to refer to a down hole device capable of inflation with inflation fluid for temporarily or permanently blocking off the annular space within a well (often abbreviated to packer);

- "inflate" (and "inflation") is a term used to refer to inflation of an inflatable bladder of an inflatable packer;
- "inflation fluid" is a term used to refer to non-settable fluids used to inflate the packers and/or to change the mode of operation of the tool. Inflation fluid typically includes liquids such as water and brine and the like. Inflation fluid often also includes gases such as nitrogen—however, in the context of the present invention it is not desired to use gaseous inflation fluids;
- "inflation lines" is a term used to refer to a flexible hydraulic tube used to connect inflation fluid under pressure to a downhole tool or packer to permit control of the operation of the tool and inflation of the packer (also referred to as inflation tubes or tubing and control lines or tubing);
- "low hydrostatic head" (or low static head) is a term used to refer to conditions where the hydrostatic pressure at a given depth in the well or bore is low compared with pressures that would normally be expected (also referred to as "dry wells"). This can be caused by shallow operation (less than 350 meters head of water) or by the well having low water pressure—that is, being relatively "dry";
- "pressure" in the context of the present invention is a term used to refer to differential pressure across one or more components and, unless otherwise specifically stated, any reference to pressure refers to differential pressure rather than absolute pressure;
- "running in" is a term used to refer to the operation of lowering a tool and/or drill rods and the like into a well bore;
- "setting tool" is a term used to refer to a multifunction down-hole tool capable of changing the mode of operation of an inflatable packer and is often abbreviated to "tool";
- "well" is a term used to refer to a hole bored in the ground. The term well is used interchangeably with bore, well bore and borehole;
- "well fluid" is a term used to refer to a combination of gas, oil, water and suspended solids, that comes out of a well.

BACKGROUND OF THE INVENTION

Inflatable packers can be activated in a number of ways, including by movement of a control string upon which the packers are lowered into a bore hole/well, and by inflation lines run within the annular space of the well bore. In the former configuration mechanical manipulation of the packers permits changes in their mode of operation and is suitable for deeper and higher pressure operation. In the latter configuration typically nitrogen gas is used for inflating the packers and is suitable for shallow and low pressure operation.

One of the challenges with using liquid as an inflation medium, is that in unsaturated (dry) formations there is an overbalance of hydrostatic pressures between the liquid in the inflation line versus the hydrostatic pressure present in the annulus (annular space). This overbalance in hydrostatic pressure can result in the packer prematurely inflating and ultimately will not allow the packer to deflate, typically by venting to surface. Ordinarily this is overcome by using gas inflation systems. However, this requires a supply of nitrogen gas. Also, gas packers have a limited operating depth due to the limits of pressure found in compressed gas cylinders. Gas packers are also prone to inaccuracies in their operation and hence liquid controlled inflatable packers are preferred.

In order to use liquid operated packers in boreholes with low static water levels we found it most effective to provide a dump valve to isolate the hydrostatic pressure in the inflation line from the packer and at the same time provide communication from the inflatable packer to the annulus to allow downhole deflation.

We found that the hydraulic dump valve prevents premature inflation by providing resistance to the overbalance of hydrostatic pressure in the inflation line, which would otherwise inflate the packer (prematurely). The hydraulic dump valve also provides a flow path from the inflatable packer to the annulus, therefore as long as the hydraulic dump valve is able to resist the overbalance of hydrostatic pressure in the inflation line, the packer will deflate/vent liquid downhole, which eliminates the effects differential hydrostatic pressure present in unsaturated sections of the borehole or boreholes with low static water levels.

The hydraulic dump valve of the present invention prevents premature inflation and enables downhole deflation. It allows a liquid filled inflatable packer to be reliably operated (inflate/deflate) in boreholes which are unsaturated or have a low static water level.

SUMMARY OF THE INVENTION

Therefore, it is an object of the present invention to provide a hydraulic dump valve for permitting the deflation of an inflatable packer under conditions of low hydrostatic pressure operation and provide resistance to any hydrostatic differential which may cause premature inflation.

In accordance with one aspect of the present invention, there is provided a hydraulic dump valve for use with an inflatable packer in a downhole installation, the hydraulic dump valve including:

an inlet disposed for receiving inflation fluid;

an outlet for communication of said inflation fluid to the inflatable packer for inflation thereof;

a piston assembly disposed for controlling flow of said inflation fluid between the inlet and the outlet;

a spring means bearing against the piston assembly, the spring means allowing movement of the piston assembly by the force of said inflation fluid above a preset pressure differential for permitting flow of inflation fluid past the piston assembly;

a venting port disposed downstream of the piston assembly, the venting port being closed off by the piston assembly for pressure differentials exceeding said preset pressure and being opened by the piston assembly for lower pressures; and whereby, the inflatable packer is filled with inflation fluid for pressures exceeding the preset pressure and whereby the inflatable packer deflates via the venting port for pressures below said preset pressure.

In accordance with another aspect of the present invention, there is provided an inflatable packer assembly for use in a downhole installation, the inflatable packer assembly including:

a mandrel with a coupling end having an inflation port;

an inflatable packer bladder mounted upon the mandrel and inflatable via the port;

a hydraulic dump valve mounted in the coupling end, the hydraulic dump valve including:

an inlet disposed for receiving inflation fluid;

an outlet for communication of said inflation fluid to the inflatable packer for inflation thereof;

a piston assembly disposed for controlling flow of said inflation fluid between the inlet and the outlet;

a spring means bearing against the piston assembly, the spring means allowing movement of the piston assembly by the force of said inflation fluid above a preset pressure differential for permitting flow of inflation fluid past the piston assembly;

a venting port disposed downstream of the piston assembly, the venting port being closed off by the piston assembly for pressure differentials exceeding said preset pressure and being opened by the piston assembly for lower pressures; and whereby, the inflatable packer bladder is filled with inflation fluid for pressures exceeding the preset pressure and whereby the inflatable packer bladder deflates via the venting port for pressures below said preset pressure.

In accordance with another aspect of the present invention, there is provided a method of operating an inflatable packer in a well, the method including the steps of:

injecting inflation fluid into the inflatable packer via a hydraulic dump valve including:

- an inlet disposed for receiving inflation fluid;
- an outlet for communication of said inflation fluid to the inflatable packer for inflation thereof;
- a piston assembly disposed for controlling flow of said inflation fluid between the inlet and the outlet;
- a spring means bearing against the piston assembly, the spring means allowing movement of the piston assembly by the force of said inflation fluid above a preset pressure differential for permitting flow of inflation fluid past the piston assembly;
- a venting port disposed downstream of the piston assembly, the venting port being closed off by the piston assembly for pressure differentials exceeding said preset pressure and being opened by the piston assembly for lower pressures;

blocking inflation fluid from entering the inflatable packer with the piston assembly for inflation fluid pressures below the preset pressure;

permitting inflow of inflation fluid into the inflatable packer via the piston assembly for inflation fluid pressures exceeding the preset pressure; and, permitting flow of said inflation fluid out of the inflatable packer via the venting port when pressure of the inflation fluid upstream of the hydraulic dump valve falls below the preset pressure.

Typically, the spring means is a bank of disc springs, conveniently in the form of slightly domed washers, the number and resilience of which can be varied to vary the preset pressure differentials of the movement of the piston assembly. These disc springs are typically referred to as a "spring stack". However, the spring means could be in the form of a coil spring.

Throughout the specification, unless the context requires otherwise, the word "comprise" or variations such as "comprises" or "comprising", will be understood to imply the inclusion of a stated integer or group of integers but not the exclusion of any other integer or group of integers. Likewise the word "preferably" or variations such as "preferred", will be understood to imply that a stated integer or group of integers is desirable but not essential to the working of the invention.

BRIEF DESCRIPTION OF THE DRAWING(S)

Exemplary embodiments of the present invention will now be described with reference to the accompanying drawing, in which:—

DESCRIPTION OF EXEMPLARY EMBODIMENT(S)

Figures 1, 2, 3:
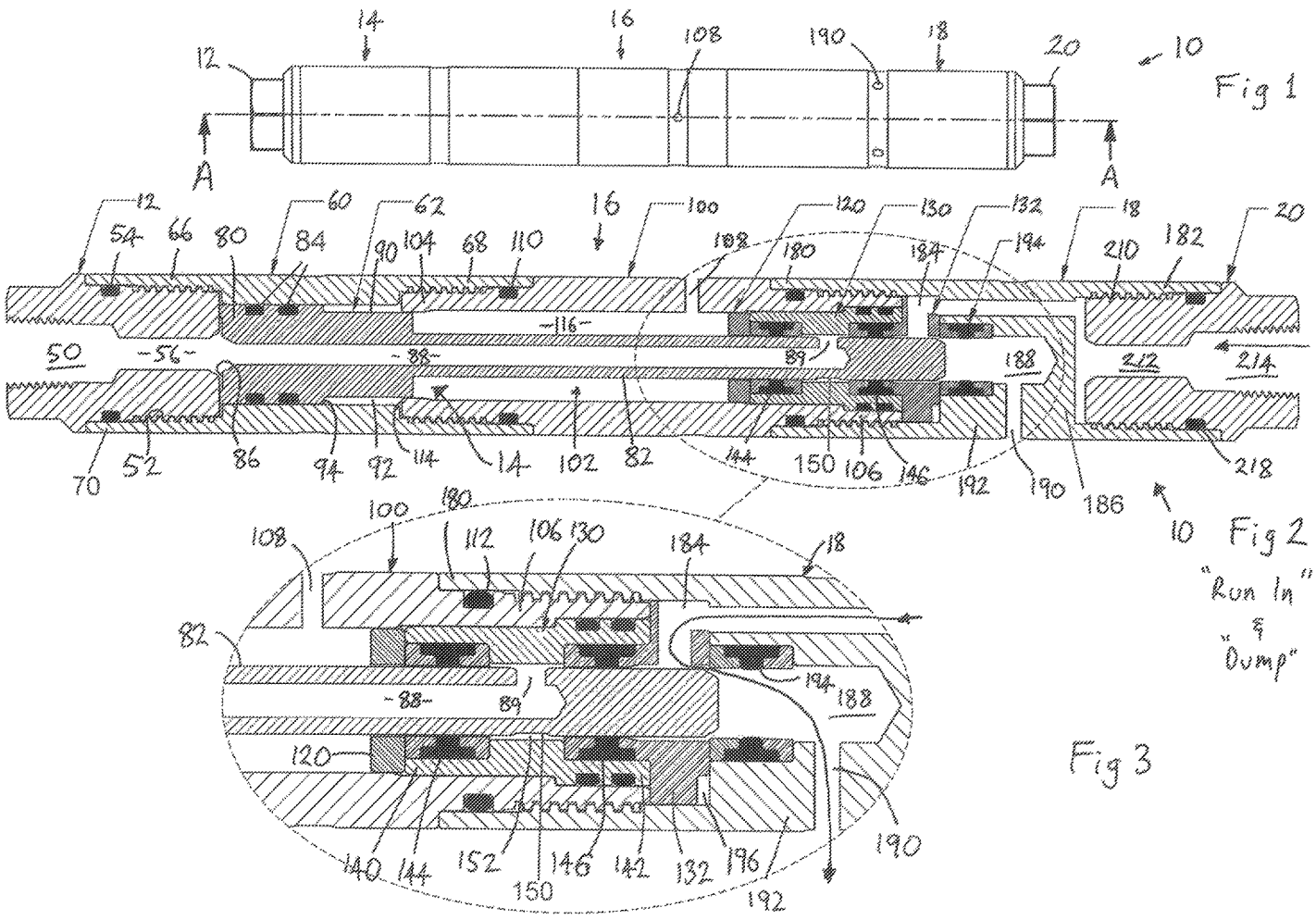
FIG. 1 is a side view of a hydraulic dump valve in accordance with the present invention.
FIG. 2 is a longitudinal cross-sectional view of the hydraulic dump valve of FIG. 1 taken on lines A-A, shown in a "running in" and "dump" mode of operation and with a spring stack (see FIG. 7) removed for clarity.
FIG. 3 is an enlarged cross-sectional view of part of the hydraulic dump valve of FIG. 2 showing a dump flow path in more detail.
Figures 4, 5:
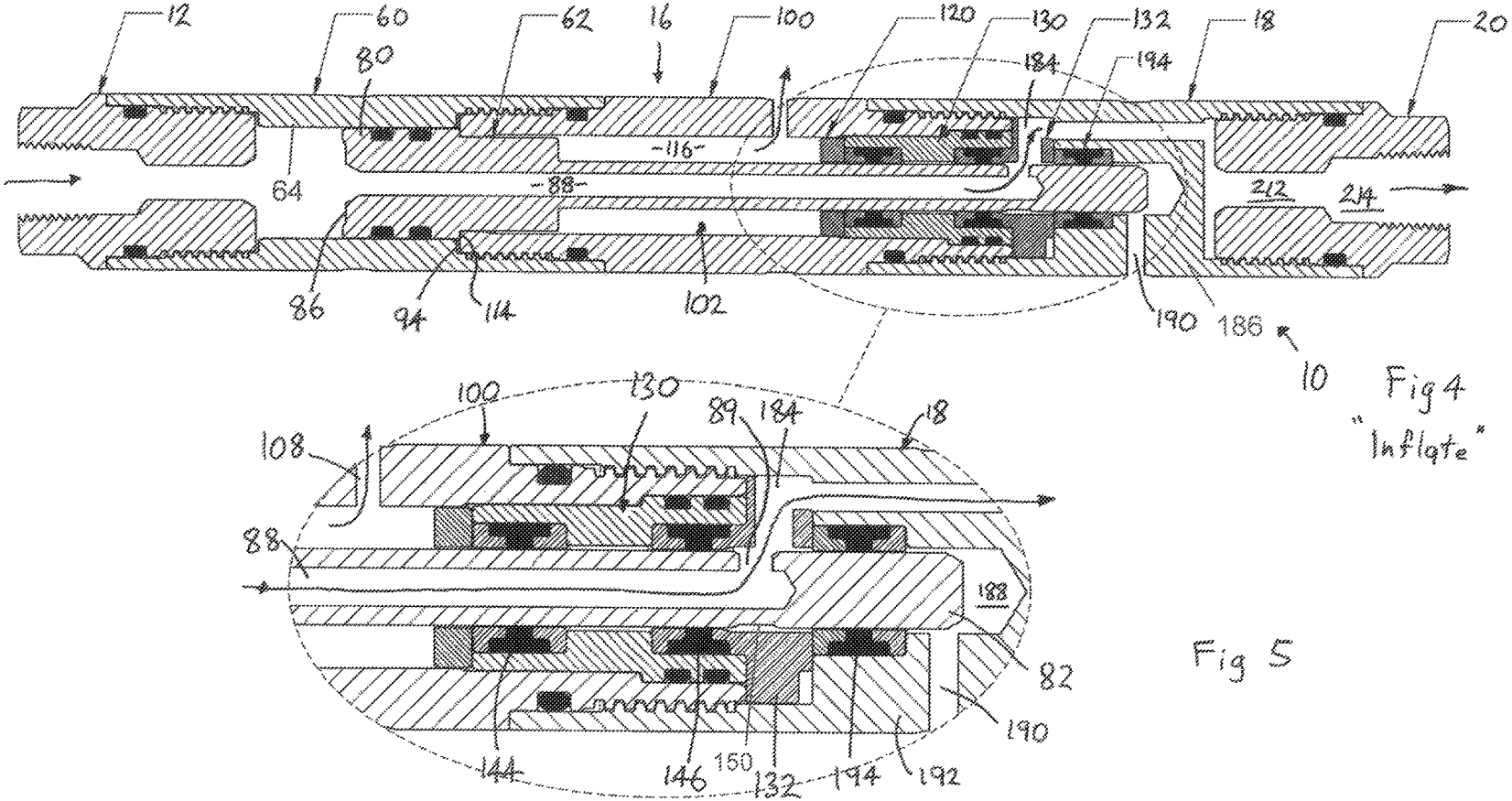
FIG. 4 is a longitudinal cross-sectional view of the hydraulic dump valve of FIG. 2, shown in an "inflate" mode of operation.
FIG. 5 is an enlarged cross-sectional view of part of the hydraulic dump valve of FIG. 4 showing an inflation path in more detail.

In one exemplary embodiment of the present invention there is described a hydraulic dump valve 10 including an inlet end sub 12, a piston assembly 14, a spring assembly 16, a deflation sub 18 and an outlet end sub 20, particularly as shown in FIGS. 1, 2 and 4.

The inlet end sub 12 is threadably attached to the piston assembly 14, which is threadably attached to the spring assembly 16, which is threadably attached to the deflation sub 18, which is threadably attached to the outlet end sub 20. Each of the components 12 to 20 are generally elongate and cylindrical in shape and made of metals materials. Typically, the components 12 to 20 are made from stainless steel. Each of the components 12 to 20 also have passageways to allow the flow of inflation fluid through them so that inflation fluid can flow from the inlet end sub 12 to the outlet end sub 20. The flow of inflation fluid through the hydraulic dump valve 10 is controlled by the various modes of operation of the valve 10 described hereinafter.

Figure 8:
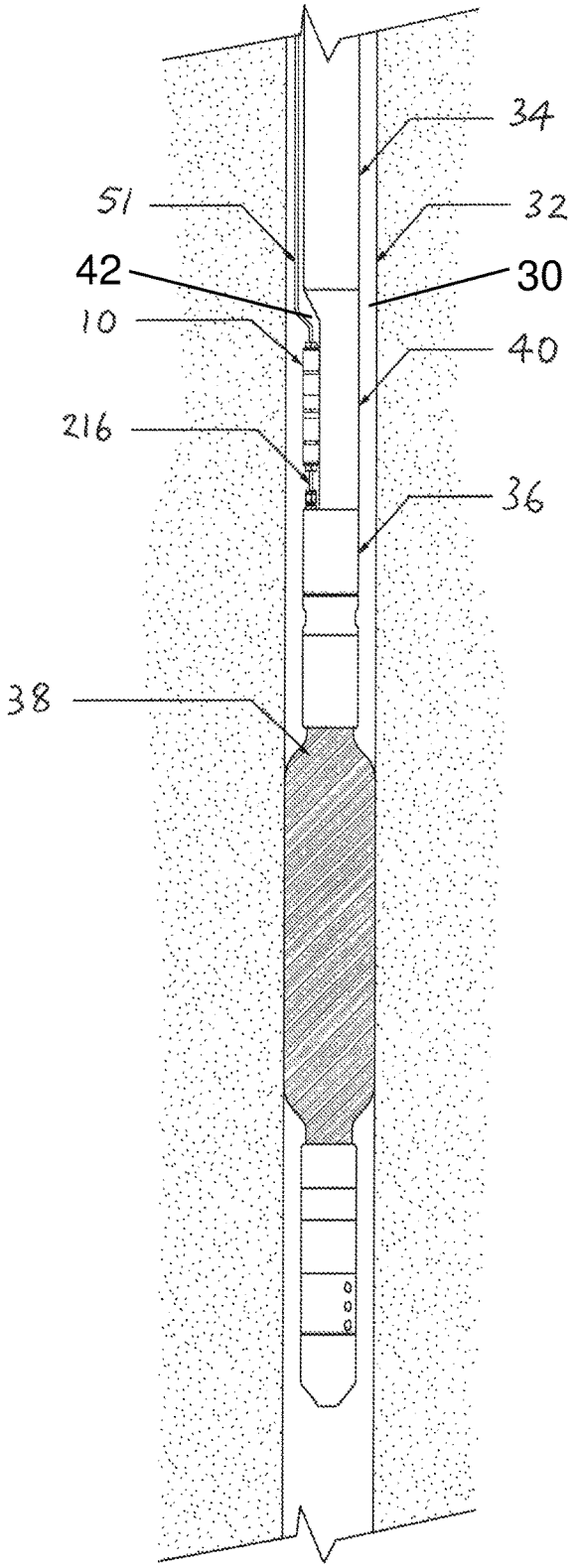

The hydraulic dump valve 10, in the exemplary embodiment, is dimensioned to fit within an annular space 30 defined between a well bore 32 and a drill string 34, as shown in FIG. 8, located upstream of an inflatable packer 36 having an inflatable bladder 38.

Typically, a housing sub 40 is provided at the downstream end of the drill string 34, adjacent the inflatable packer 36. The housing sub 40 has an external recess 42 dimensioned to retain the hydraulic dump valve 10. Typically, the housing sub 40 also has a retainer to avoid the hydraulic dump valve 10 falling out of the recess 42 during running in.

Alternatively the hydraulic dump valve 10 can be located within the drill string 34.

The inlet end sub 12 has an internally threaded and tapered port 50 for connecting to a hydraulic line, such as a hydraulic control line 51, commonly used for inflating packers, as shown in FIG. 8. The end sub 12 also has an external thread 52 for threadably mating with the piston assembly 14. Also located externally of the end sub 12 is an o-ring seal 54 for hydraulically sealing the end sub 12 to the piston assembly 14. The end sub 12 also has a central passageway 56 for delivery of inflation fluid from the control line 51 to the piston assembly 14.

The piston assembly 14 includes a piston cylinder 60 and a sliding piston 62 located within the bore 64 of the of the piston cylinder 60. The piston cylinder 60 has internally threaded ends 66 and 68. The end 66 threadably engages with the thread 52 of the end sub 12. The end 66 terminates in a flange 70 whose internal circumferential wall seals against the o-ring 54.

The sliding piston 62 has a head 80 mounted on a shaft 82. The head 80 has 2 o-ring seals 84 slideably sealing against the inner cylindrical surface of the piston cylinder 60. The head 80 also has a crown 86 with a central hole 88 that extends along the majority of the longitudinal axis of shaft 82 and exits the shaft 82 at a port 89. The head 80 further has a narrow skirt 90 which defines an annular cavity 92 with the inner curved surface of the piston cylinder 60. The narrow skirt 90 has a smaller circumferential dimension than the rest of the head 80, as defined by a shoulder 94.

The spring assembly 16 includes a spring housing 100 and a spring 102. The spring housing 100 has an upstream end 104 and a downstream end 106, both with external threads. The spring housing 100 also has at least one radial port 108 and two o-rings 110 and 112. The end 104 has an external thread that engages with the end 68 of the piston cylinder 60. The end 104 terminates at a lip 114 which is dimensioned to bear against the shoulder 94 to limit the travel of the head 80 within the piston cylinder 60, particularly as shown in FIG. 4. The lip 114 defines one end of the annular cavity 92.

The shaft 82 of the sliding piston 62 extends through the spring housing 100 and defines an annular cavity 116 with the spring housing 100. The cavity 116 is dimensioned to receive the spring 102.

Typically, the spring 102 is in the form of a stack of disc springs 118, commonly referred to as a spring stack. The stack of disc springs 118 is an example of the spring means of the present invention. Each disc spring 118 is a frusto-conical washer with a body typically angled at about 7 degrees off its plane with a convex side and a concave side and having a central hole dimensioned to receive the shaft 82 of the sliding piston 62. The outer dimension of the discs 118 is sufficiently small to allow for insertion within the spring housing 100 in the cavity 118. Typically, the discs 118 are arranged with alternate discs 118 having their concave sides facing each other, although in a proportion of cases two or more of the discs 118 nest upon each other with the concave side of one disc 118 receiving the convex side of a neighbouring disc 118. In the exemplary embodiment there are 55 discs 118 collected in a stack with one set of three discs 118 nested (referred to as a triple 118*a*), 2 pairs of discs 118 nested (referred to as doubles 118*b*) and 48 discs 118 stacked face to face (referred to as singles 118*c*). All of the discs 118 have substantially the same resilience and hence spring tension. The doubles 118*b* and the triple discs 118*a* do not tend to compress but provide packing, whereas the non-nested discs provide resilience against the compressive force of inflation fluid. The amount of resilient force which the spring 102 is compressed by can be varied by varying the number of discs arranged face to face compared to the number nested upon each other. The amount of resilient force that compresses the spring 102 can also be varied by varying the resilience of each of the discs 118. However, in the field it is more convenient to vary the resilience of the spring 102 by the former method.

It is envisaged that a set screw could also be used to pre-tension the spring stack 118 to vary its operating tension.

One end of the spring 102 presses against the head 80 of the sliding piston 62 and the other end of the spring 102 presses against an annular spring base 120 located within the spring housing 100 upon the shaft 82 of the sliding piston 62.

The port 108 allows fluid to flow between the annular cavity 116 of the spring assembly 16 and the annular cavity 30 of the well bore 32. This keeps the pressure around the spring 102 at the same pressure as in the well bore 32 (above the inflatable packer 36). The difference in fluid pressure between the central hole 88 and the annular cavity 116 is then considered to be the operating pressure of the hydraulic dump valve 10 of the present invention.

The spring 102 compresses as the inflation fluid at the port 50 increases. In the exemplary embodiment, the spring 102 is configured to be fully compressed when subjected to pressure differentials exceeding approximately 3,500 kPa (500 psi). That is, for pressure differentials greater than about 3,500 kPa the spring 102 compresses sufficiently for the port 89 to be opened for communication with the inflatable packer 36 and hence opens the valve 10.

Figure 6:
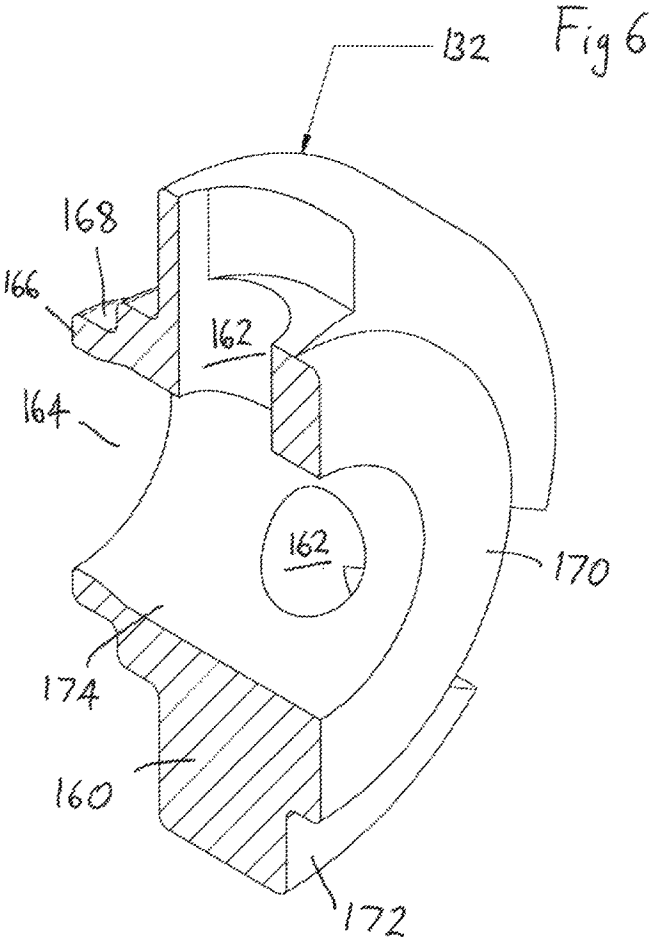
FIG. 6 is cross-sectional perspective view shown from above of a port ring of the hydraulic dump valve of FIGS. 2 to 5, shown to an enlarged scale.
Figure 7:
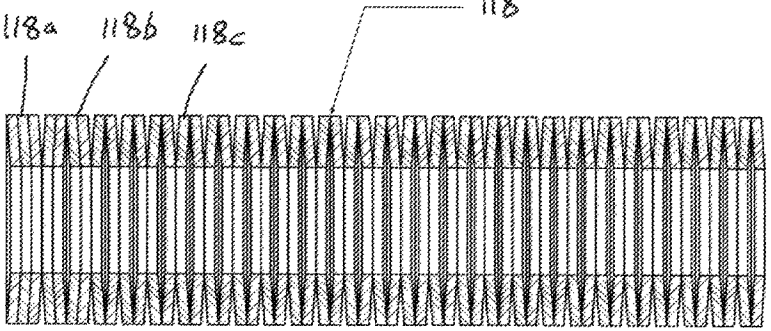
FIG. 7 is a cross-sectional side view of a stack of disc springs forming a spring of the hydraulic dump valve of FIGS. 1, 2 and 4; and, FIG. 8 is a schematic side view of the hydraulic dump valve of FIG. 1 shown in use in a bore hole/well in a through tube configuration.

Located in the downstream end 106 is a seal housing 130 and a port ring 132, shown in more detail in FIGS. 3, 5 and 6.

The seal housing 130 is coaxial with the downstream end 106 of the spring housing 100 and provides a sliding seal for the shaft 82 of the sliding piston 62. An upstream end 140 of the seal housing 130 bears against the spring base 120 and a downstream end 142 bears against the port ring 132. The seal housing 130 has, for example, a T-seal 144 confined in its upstream end 140 upon the shaft 82 upstream of the exit port 89 of the central hole 88 of the sliding piston 62. The seal housing has another T-seal 146 confined in its downstream end 142. Part of the confinement of the T-seal 144 is provided by the port ring 132.

Each T-seal 140 and 144 is made of resilient material as is typically used for sealing in downhole tools. The sides of each T-seal 140 and 144 are retained within metal material rings having an L-shaped cross-section. A base of each T-seal is stationary with respect to the metal material rings and a leg of each T-seal seals against the shaft 82 of the sliding piston 62 as it moves within the piston cylinder 60 and the spring housing 100.

The shaft 82 has a circumferential channel 150 disposed to connect the outer end of the port 89 and which provides an annular cavity 152 with the T-seals 144 and 146, as shown in FIG. 3. The annular cavity 152 moves into the port ring 132, shown in FIG. 5, when the sliding piston 62 depresses the spring 102.

The port ring 132, particularly as shown in FIG. 6, has a body 160 with a plurality of radially disposed ports 162 communicating from an axial hole 164 dimensioned to receive the shaft 82 of the sliding piston 62. Typically, there are 3 ports 162 arranged at 120 degrees radially with respect to each other. An upstream end 166 of the port ring 132 has an annular recess 168 for receiving the T-seal 146. A downstream end 170 of the port ring 132 has another annular recess 172 for communicating inflation fluid between the ports 162 from the central hole 88 in the sliding piston 62. The axial hole 164 is provided with a relief 174 adjacent the upstream end 166 for avoiding contact between the shaft 82 and the axial hole 164 to permit communication of inflation fluid between the ports 162 in the axial hole 164.

The deflation sub 18 has an upstream end 180 and a downstream end 182, both internally threaded, as shown in FIGS. 2 to 5. The upstream end 180 is threaded onto the downstream end 106 of the spring housing 100 and the downstream end 182 is threaded onto the end sub 20. The deflation sub 18 has one or more passageways 184 leading from its upstream end 180 to its downstream end 182 for the communication of inflation fluid from the port ring 132 to the end sub 20 and thereby to the inflatable packer 36.

The deflation sub 18 also has a body 186 with a central sump 188 vented to the exterior of the hydraulic dump valve 10 via a port 190. An upstream end 192 of the body 186 has a recess for receiving another T-seal 194 dimensioned to seal against the shaft 82 of the sliding piston 62 when it is depressed against the disc spring stack 102. The T-seal 194 is identical to the T-seals 140 and 144 and is held in place by the port ring 132. The annular recess 172 of the port ring 132 and upper end 192 of the body 186 form an annular cavity 196 which acts as a manifold communicating between the ports 162 to balance their flow to the passageways 184.

The outlet end sub 20 is identical to the inlet end sub 12. The end sub 20 has an external thread 210 for threadably mating with the downstream end 182 of the deflation sub 18. The end sub 20 also has a central passageway 212 leading to an internally threaded and tapered axial hole 214 for receiving a fluid coupling connected upon a hose 216 for connecting to the inflatable packer 36, as shown in FIG. 8. Located externally of the end sub 20 is an o-ring seal 218 for hydraulically sealing the end sub 20 to the deflation sub 18.

In an alternative arrangement the hydraulic dump valve 10 of the present invention may be installed inside the drill string 34 upstream of the inflatable packer 36. This avoids the need for the control line 51—but increases the amount of inflation fluid needed to prime the string to permit operation of the valve 10.

In a further alternative arrangement the hydraulic dump valve 10 of the present invention may be installed in the upstream end of the inflatable packer assembly 36.

It is envisaged that the spring 102 could be replaced with a coil spring.

Typically, grease is packed around the spring 102 to avoid the spring stack 118 becoming clogged with debris.

It is envisaged that the valve 10 of the present invention could be operated at much higher pressures than stated in this exemplary embodiment, such as, for example, up to about 70 Mpa (10,000 psi)

Use

Prior to assembly the spring 102 is adjusted for the desired pressure of operation.

Adjustment is typically achieved by changing the stacking of the disc springs 118 between singles 118*c*, doubles 118*b* and triples 118*a*. The actual pressure of operation of the valve hydraulic dump 10 can then be tested on the surface above the well prior to running in.

To prepare the hydraulic dump valve 10 for use the housing sub 40 is first attached to the packer 36. The hydraulic dump valve 10 is then located in the recess 42 of the housing sub 40 and the hose 216 connected between the outlet 20 of the hydraulic dump valve 10 and the inlet of the packer 36. The control line 51 is the connected to the inlet 12 of the hydraulic dump valve 10. Then the drill string 34 is attached to the housing sub 40 and the assembly run into the well bore 32 to the desired operating depth.

The hydraulic dump valve 10 of the present invention is capable of use at low hydrostatic pressure. For example, the hydraulic dump valve 10 capable of use at less than 3,500 kPa which is equivalent to a head of about 350 meters of water. However, the valve 10 is also capable of use at higher pressure, for example, around 70 Mpa (10,000 psi).

In use, the hydraulic dump valve 10 is run into the well bore 32. During running in it is important that inflation fluid be prevented from entering into the packer 36 which would otherwise lead to inflation of the packer 36, resulting in jamming of the drill string 34 and/or damage to the packer 36. During running in the spring 102 experiences the pressure of the fluid in the well via the port 108. The pressure differential from the control line 51 to the annular space 30 acts upon the spring 102. For pressure differentials less than the preset pressure (say around 3,500 kPa, in the present embodiment) the disc springs 118 do not fully compress and the hydraulic dump valve 10 does not open.

Once the packer 36 is run into its desire depth it is normal procedure to inflate the one or more packers 36. In order to do this inflation fluid is injected into the inflation line 51 in known manner. When the pressure differential of the inflation fluid exceeds the preset pressure the spring 102 is fully compressed by the sliding piston 62, which is sealed against the T-seals 144 and 146, and the shaft 82, of the sliding piston 62, meets the T-seal 194 and the port 89 opens to the passageway 184. This permits the inflation fluid to flow through the sliding piston 62 through the passageway 184 out of the end sub 20 and into the inflatable packer 36 to inflate the packer 36.

The preset pressure at which the sliding piston 62 moves to open the passageway 184 can be changed by changing the arrangement of the disc springs 118 in the spring 102.

The valve 10 of the present invention is intended for low hydrostatic pressure use and so preset pressures are typically less than 3,500 kPa. Increasing the number of double and triple stacks has the effect of increasing the preset pressure and vice versa. However, it is also capable of operation at much higher pressures.

During running in inflation fluid, below the preset pressure, is prevented from entering into the inflatable packer 36 by the sliding piston 62 sealing off the passageway 184. This has the effect of preventing inadvertent inflation of the packer 36 during running in.

Once the inflatable packer 36 is run into its desired depth of operation the pressure of the inflation fluid in the control line 51 is increased above the preset pressure so as to drive the sliding piston 62 against the spring 102 to open the passageway 184 and inflate the packer 36.

So long as the fluid pressure in the control line 51 is maintained the packer 36 remains inflated.

Once it is desired to deflate the packer 36 the pressure in the control line 51 is removed or otherwise reduced from the preset pressure, which permits the spring 102 to drive the sliding piston 62 upstream to close off the passageway 184. Simultaneously this opens the passageway 184 to the sump 188 which experiences the same pressure as the annular space 30 of the well bore 32 and permits venting of the packer pressure back through the end sub 20, the passageway 184, the sump 188 and exiting via the venting port 190.

The venting port 190 provides a short path for the inflation fluid to exit the deflating packer 36. If not for the venting port 190 inflation fluid would have to exit the packer 36 via the control line 51 which can be difficult and often impossible in low hydrostatic head wells.

Advantages

The hydraulic dump valve 10 of the present invention has the advantage that deflation of the packer 36 is via a venting port 190 located adjacent and upstream of the packer 36 thus avoiding locking that can otherwise happen in shallow/low pressure/low hydrostatic head wells.

The hydraulic dump valve 10 of the present invention has the further advantage that it avoids inadvertent inflation of the packer 36 during running in operations.

Also, the spring 102 has the advantage of permitting easy change in the preset pressure of activation of the hydraulic dump valve 10.

MODIFICATIONS AND VARIATIONS

It will be readily apparent to persons skilled in the relevant arts that various modifications and improvements may be made to the foregoing embodiments, in addition to those already described, without departing from the basic inventive concepts of the present invention. For example, seals other than T-seals 144 and 146 could be used provided they resist washout by passing inflation fluid. Also, the hydraulic dump valve 10 could be operated at hydrostatic pressures other than those mentioned herein.

The invention claimed is:

1. A hydraulic dump valve for use in running in, inflation and deflation of an inflatable packer in a downhole installation, the hydraulic dump valve being connected between a control rod and the inflatable packer for controlling flow of inflation fluids into and out of the inflatable packer, the hydraulic dump valve including:

an inlet connected to the control rod for receiving inflation fluid;

an outlet connected to the inflatable packer for communication of said inflation fluid to the inflatable packer;

a piston assembly disposed between the inlet and the outlet for controlling flow of said inflation fluid, the piston assembly comprising a piston having a head and a shaft, with a conduit passing through the head and part way along the length of the shaft, the conduit exiting the shaft adjacent an end of the shaft distal from the head;

a spring means bearing against the head of the piston and urging the piston to prevent flow of inflation fluid to the inflatable packer, the spring means allowing movement of the piston by the force of said inflation fluid above a preset inflation pressure differential for permitting flow of inflation fluid through the conduit in the piston for inflation of the inflatable packer;

an inflation port disposed proximate a downstream end of the piston, the inflation port being closed against the downstream end of the piston for pressures below the preset inflation pressure differential, and the inflation port being opened by movement of the head of the piston in a downstream direction so that a downstream end of the conduit comes into communication with the inflation port for pressures above the preset inflation pressure differential; and a venting port disposed proximate the downstream end of the piston, the venting port being in communication with the inflation port for inflation pressures below the preset pressure differential, and the venting port losing communication with the inflation port by movement of the distal end of the shaft of the piston for pressure differentials exceeding said preset pressure differential;

whereby inflation fluids flow from the inlet into the conduit in the piston thereby forcing the piston against the restraining force of the spring means;

whereby, the inflatable packer is inflated when inflation above the preset pressure differential moves the piston against the spring means to open the inflation port for permitting flow of the inflation fluid through the conduit in the piston and through the inflation port; and whereby the inflatable packer deflates when the inflation fluid pressure is below the preset pressure differential allowing the spring means to move the piston upstream closing off the inflation port from the conduit and opening communication of the inflation port with the venting port.

2. The hydraulic dump valve according to claim 1, in which the spring means is a bank of disc springs, the number and resilience of which can be varied to vary the preset pressure differentials of the movement of the piston assembly.

3. An inflatable packer assembly for use in a downhole installation deployed on control rods, the inflatable packer assembly including:

a mandrel with a coupling end having an inflation port;

an inflatable packer bladder mounted upon the mandrel and inflatable via the inflation port;

a hydraulic dump valve mounted in the coupling end, the hydraulic dump valve including:

an inlet connected to the control rod for receiving inflation fluid;

an outlet connected to the inflatable packer for communication of said inflation fluid to the inflatable packer;

a piston assembly disposed between the inlet and the outlet for controlling flow of said inflation fluid, the piston assembly comprising a piston having a head and a shaft, with a conduit passing through the head and part way along the length of the shaft, the conduit exiting the shaft adjacent an end of the shaft distal from the head;

a spring means bearing against the head of the piston and urging the piston to prevent flow of inflation fluid to the inflatable packer, the spring means allowing movement of the piston by the force of said inflation fluid above a preset inflation pressure differential for permitting flow of inflation fluid through the conduit in the piston for inflation of the inflatable packer;

the inflation port disposed proximate a downstream end of the piston, the inflation port being closed against the downstream end of the piston for pressures below the preset inflation pressure differential, and the inflation port being opened by movement of the head of the piston in the downstream direction so that a downstream end of the conduit comes into communication with the inflation port for pressures above the preset inflation pressure differential; and a venting port disposed proximate the downstream end of the piston, the venting port being in communication with the inflation port for inflation pressures below the present pressure differential, and the venting port losing communication with the inflation port by movement of the distal end of the shaft of the piston for pressure differentials exceeding said preset pressure differential; and whereby inflation fluids flow from the inlet into the conduit in the piston thereby forcing the piston against the restraining force of the spring means; and whereby, the inflatable packer bladder is inflated when inflation fluid above the present pressure differential moves the piston against the spring means to open the inflation port for permitting flow of inflation fluid through the conduit in the piston and through the inflation port; and whereby the inflatable packer bladder deflates when the inflation fluid pressure is below the preset pressure differential allowing the spring means to move the piston upstream closing off the inflation port from the conduit and opening communication of the inflation port with the venting port; and whereby the hydraulic dump valve controls the inflatable packer for use in running in, inflation and deflation of the inflatable packer.

4. The inflatable packer assembly according to claim 3, in which the spring means is a bank of disc springs, the number and resilience of which can be varied to vary the preset pressure differentials of the movement of the piston assembly.

5. A method of operating an inflatable packer in a well using a hydraulic dump valve connected between a control rod and the inflatable packer, the method including the steps of:

injecting inflation fluid into the inflatable packer from the control rod via the hydraulic dump valve, the hydraulic dump valve including:

an inlet connected to the inflatable packer for receiving inflation fluid;

an outlet connected to the inflatable packer for communication of said inflation fluid to the inflatable packer;

a piston assembly disposed between the inlet and the outlet for controlling flow of said inflation fluid, the piston assembly comprising a piston having a head and a shaft, with a conduit passing through the head and part way along the length of the shaft, the conduit exiting the shaft adjacent an end of the shaft distal the head;

a spring means bearing against the head of the piston and urging the piston to prevent flow of inflation fluid to the inflatable packer, the spring means allowing movement of the piston by the force of said inflation fluid above a preset inflation pressure differential for permitting flow of inflation fluid through the conduit in the piston for inflation of the inflatable packer;

an inflation port disposed proximate a downstream end of the piston, the inflation port being closed against the downstream end of the piston for pressures below the preset inflation pressure differential, and the inflation port being opened by movement of the head of the piston in the downstream direction so that a downstream end of the conduit comes into communication with the inflation port for pressures above the preset inflation pressure differential; and a venting port disposed proximate the downstream end of the piston, the venting port being in communication with the inflation port for inflation pressures below the preset pressure differential, and the venting port losing communication with the inflation port by movement of the distal end of the piston for pressure differentials exceeding said preset pressure differential and being opened by the piston assembly for lower pressures;

blocking inflation fluid from entering the inflatable packer with the distal end of the shaft of the piston for inflation fluid pressures below the preset pressure;

permitting inflow of inflation fluid into the inflatable packer via the conduit in the piston and the inflation port for inflation fluid pressures exceeding the preset pressure; and, permitting flow of said inflation fluid out of the inflatable packer via the venting port when pressure of the inflation fluid upstream of the hydraulic dump valve falls below the preset pressure for deflation of the inflatable packer.

6. The method of operating an inflatable packer according to claim 5, in which the spring means is a bank of disc springs, and wherein the method includes the step of varying the preset pressure differentials of the movement of the piston assembly by varying the number and resilience of the disc springs in the bank of disc springs.

* * * * *